US006393948B1

(12) United States Patent
Hutchins

(10) Patent No.: US 6,393,948 B1
(45) Date of Patent: May 28, 2002

(54) SHINGLE-REMOVING TOOL

(76) Inventor: Robert Junior Hutchins, 7618 Forest Rd., Cincinnati, OH (US) 45255

( * ) Notice: Subject to any disclaimer, the term of this patent is extended or adjusted under 35 U.S.C. 154(b) by 0 days.

(21) Appl. No.: 09/640,210

(22) Filed: Aug. 16, 2000

(51) Int. Cl.[7] ..... E04D 15/00
(52) U.S. Cl. ..... 81/45; 30/170
(58) Field of Search ..... 81/45, 44; 30/170, 30/171, 277.4, 169; 299/37; 15/236.1

(56) References Cited

U.S. PATENT DOCUMENTS

| | | | | | |
|---|---|---|---|---|---|
| 3,195,232 | A | * | 7/1965 | Toth | 30/169 |
| 4,277,104 | A | * | 7/1981 | Sanchez | 299/37 |
| 4,691,439 | A | * | 9/1987 | Marra | 30/170 |
| 4,699,430 | A | * | 10/1987 | Nichols | 299/37 |
| 4,709,479 | A | * | 12/1987 | Lavelette | 30/170 |
| 4,756,578 | A | | 7/1988 | Mims et al. | |
| 4,858,503 | A | * | 8/1989 | Dike, Jr. | 81/45 |
| 5,009,131 | A | * | 4/1991 | Alto et al. | 81/45 |
| 5,010,791 | A | * | 4/1991 | Williams | 81/45 |
| 5,076,119 | A | * | 12/1991 | Wenz | 81/45 |
| 5,218,766 | A | | 6/1993 | Himebaugh | |
| 5,800,021 | A | * | 9/1998 | Derr | 299/37.1 |
| 5,813,295 | A | * | 9/1998 | Jensen, Jr. | 81/45 |
| 5,860,519 | A | | 1/1999 | Meyer et al. | |
| 5,921,155 | A | | 7/1999 | Faller et al. | |
| 6,058,809 | A | * | 5/2000 | Flanz | 81/45 |
| 6,105,470 | A | | 8/2000 | Hutchins | |
| 6,116,117 | A | * | 9/2000 | Nichols et al. | 81/45 |

* cited by examiner

*Primary Examiner*—James G. Smith
*Assistant Examiner*—Hadi Shakeri
(74) *Attorney, Agent, or Firm*—Frost Brown Todd LLC

(57) ABSTRACT

A tool comprising a scalloped blade shiftable between a normal extended position and a retracted position is disclosed. The blade also shifts sideways. The blade is shifted between its extended position and its retracted position by a crank-driven driving assembly which converts circular motion from the motor shaft to eccentric motion and then imparts rectilinear motion to a connecting rod and driving bars which thereafter drive the blade between its two positions. The tool comprises a mounting board on which the motor and blade driving assembly are mounted. The blade is part of a blade assembly comprising a blade, a supporting member, and a side motion rod. The blade driving assembly is mounted in vibration-absorbing bearing blocks affixed to the mounting board of the tool. The tool is provided with an openable cover to keep the motor, the crank, the connecting rod, the blade support mechanism, and the bearings free from dirt and foreign material. The tool includes an adjustable handle.

6 Claims, 8 Drawing Sheets

SHINGLE-REMOVING TOOL

U.S. Pat. No. 6,105,470 is hereby incorporated by reference into the current application.

TECHNICAL FIELD

The invention relates to a shingle-removing tool, and more particularly to a tool with a reciprocating shingle-removing blade and an improved blade driving assembly.

BACKGROUND ART

Roof removal is a labor-intensive operation. Frequently, there are multiple layers of roofing material. Often shingles, clapboard, or shakes laid in overlapping rows on a roofing substrate/sheathing cover the roofs and walls of buildings. These may be removed down to the sheathing to which the shingles arc nailed, glued, or otherwise attached. The removal operation is generally accomplished manually or by using tools which only effect removal by undercutting the shingles and roofing nails, lifting the shingle material, and pushing the shingle material ahead of the tool. Prior art motorized shingle removing tools utilize a cam-driven driving assembly which has several disadvantages. The cam-driven assembly requires additional parts and is therefore heavier and not as easy to manipulate. Second, the cam-driven assembly has been found to result in excessive vibration and therefore increased wear and tear on the tool.

SUMMARY OF THE INVENTION

A tool capable of removing various layers (stratum) from a variety of surfaces, including roofing shingles/sheathing/shakes/clapboard from a roof substrate or carpet from a floor substrate, comprises a base or mounting board, a blade assembly, and a blade driving assembly. The blade assembly is attached to the blade driving assembly and the blade driving assembly is mounted on a mounting board or base. The blade driving assembly may be further improved by employing a crank-driven blade driving assembly.

In one embodiment, a tool capable of removing stratum comprises a mounting board, a crank-driven blade driving assembly further comprising at least two driving bars, and a blade assembly wherein the blade assembly further comprises a blade, a support member, a side motion rod. The blade has a scalloped edge, having top and bottom surfaces that is capable of reciprocating back and forth and from side to side. The support member, having horizontal and vertical portions, is affixed to the blade by appropriate fasteners. The horizontal portion of the support member is affixed to the top portion of the blade. The side motion rod includes a protruding radius and an inside radius in alignment with the support-member-to-blade fasteners. The side motion rod is attached to the mounting board and extends through an opening in the vertical portion of the support member. The side motion rod is further disposed between the fasteners. The driving bars are slidably mounted within at least two bearing blocks, which are mounted on the mounting board.

In another embodiment, a tool capable of removing stratum comprises a mounting board, a blade assembly, and a blade driving assembly. The blade assembly further comprises a support member, a blade, and a side motion rod. The blade is attached to the horizontal portion of the support member. The side motion rod has a head portion and a rearward portion. The head portion of the side motion rod is slidably mounted in the vertical portion of the support member and is disposed between at least two fasteners connecting the blade and the support member together. The head of the side motion rod further includes inside and protruding radii disposed on either side of the head portion in alignment with the fasteners or other protrusions on the horizontal surface of the support member. The rearward portion of the side motion rod is affixed to the mounting board. The blade driving assembly comprises a motor, motor shaft, crank, at least two, parallel-spaced driving bars and a connecting rod. The driving bars are mounted in the vertical support member portion of the support member and are further slidably mounted through at least two bearing blocks. The motor is connected to the crank via the motor shaft, which is disposed within the crank. The crank has an offset hole and carries a connecting rod. The connecting rod is attached to a shaft plate which extends transversely with respect to the mounting board and which is further connected to the blade driving bars.

In another embodiment, only the improved blade assembly is part of the tool. Here, a tool capable of removing stratum comprises a mounting board, a blade-driving assembly, and a blade assembly wherein the blade assembly comprises a scalloped blade, having top and bottom surfaces, wherein the blade is capable of being shifted between a forward position and a retracted position as well as from side to side.

Finally, another embodiment of the invention includes a method of removing stratum using a tool, comprising a mounting board, a blade assembly and a crank-driven blade-driving assembly, comprising the steps of converting circular/rotary motion to reciprocating rectilinear motion; transmitting said rectilinear motion to a blade driving assembly; driving a blade on said blade driving assembly back and forth (longitudinally) and from side to side (laterally); and engaging a stratum with said blade until said stratum is removed from a substrate. More specifically, this method is achieved by transmitting circular/rotary motion from a motor to a motor shaft connected to the motor; converting the circular/rotary motion to eccentric motion by transmitting the circular/rotary motion from the motor shaft to a crank carrying a connecting rod; converting that eccentric motion to reciprocating rectilinear motion by transmitting the eccentric motion from the crank to the connecting rod, wherein the connecting rod is attached to a shaft plate extending transversely across said mounting board; transmitting the rectilinear motion to a pair of blade driving bars, connected to the shaft plate in a parallel spaced relationship, wherein said blade driving bars are slidably mounted within at least one pair of bearing blocks; transmitting the rectilinear motion from the blade driving bars to a support member to which a scalloped blade is attached to extend and retract said blade; and reciprocating the blade from side to side by the engagement of a protruding radius on one side and an inside radius on the other side of a side motion rod with at least two protrusions on said support member through which said side motion rod is disposed.

BRIEF DESCRIPTION OF THE DRAWINGS

The accompanying drawings incorporated in and forming part of the specification illustrate several aspects of the present invention. In the drawings.

Figure 1:
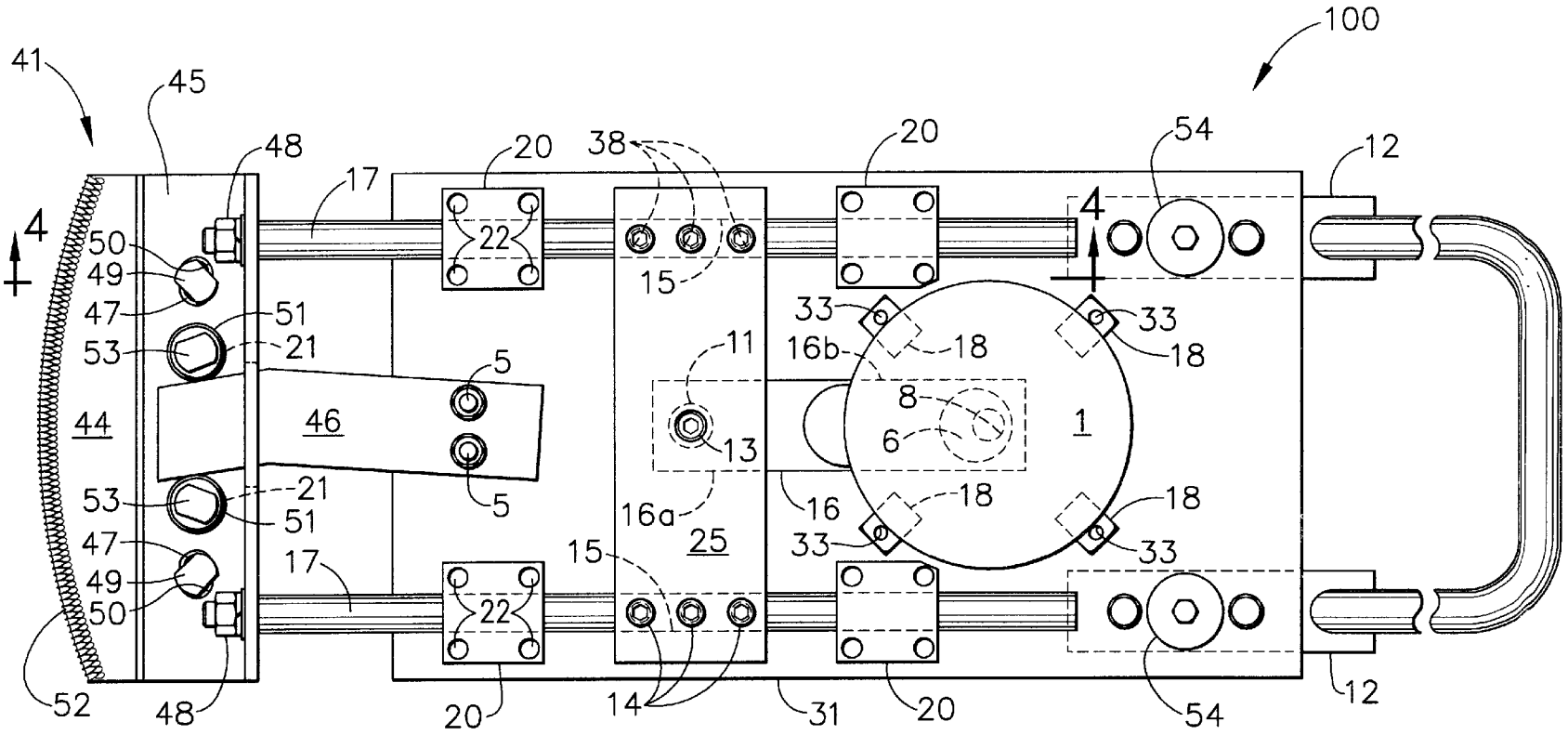
FIG. 1 is a top view of a tool constructed in accordance with the invention as disclosed herein.

Below is a parts list for the above figures.

1. Motor
2. Motor Shaft
3. Motor Shaft Key
4. Motor Shaft Keyway
5. Bolt for #46
6. Crank
7. Needle bearing
8. Offset hole in crank
9. Hole shaped for wrist pin in shaft plate
10. Hole for crank in connecting rod
11. Wrist pin
12. Bottom of Handle
13. Bolt for holding wrist pin and connecting rod in place
14. Bolt for holding shaft plate to shaft
15. Hole for shaft thru shaft plate
16. Connecting rod
17. Shaft
18. Motor mount spacers
19. Bolt hole thru motor mount
20. Bearing block
21. Shaped hole in support member iron that permits bearings to move side to side
22. Bearing block bolt
23. Bronze bearing surrounded by neoprene rubber
24. Hole thru wrist pin
25. Shaft plate
26.
27. Keyway in crank
28. Nut for #13
29. Tapped hole in motor for motor mount bolt
30.
31. Mounting board
32. Bolt for holding motor mount to motor
33. Bolt for holding motor mount to mounting board
34.
35. Tapped hole for #5 bolt
36. Through hole for #33
37. Nut for #14 and #41
38. Through hole in shaft plate for connecting shaft
39. Nut for #22
40. Bearing block hole for #22
41. Blade Assembly
42. Support bearing
43. Hole in connecting rod for wrist pin
44. Blade
45. Steel support member for shafts and blade mounting
46. Motion of blade (side motion rod)
47. Bronze bearing insert
48. Nut for holding support member iron #45 to shaft
49. Bolt for side to side blade motion
50. Tapped hole for #49
51. Roller bearing bolted on #44
52. Scalloped edge on front of blade
53. Bolt for #51
54. Shock Absorbers
55. Wheels
56. Wheel Spacer
57. Needle Bearing Clutch for Wheels
58. Axle
59. Bolt to hold Handle to Mounting Board For the purpose of promoting an understanding of the principles of the invention, reference will now be made in detail to the present preferred embodiments of the invention, examples of which are illustrated in the accompanying drawings. Specific language will be used to describe the same. It will nevertheless be understood that no limitation of the scope of the invention is thereby intended toward such alterations and further modifications in the illustrated device and such further applications of the principles of the invention as illustrated therein as would normally occur to one skilled in the art to which the invention relates.

DETAILED DESCRIPTION OF THE INVENTION

According to one embodiment of the invention there is provided a tool which, among other applications (i.e., carpet removal), may be used to effect the removal of roofs more easily and quickly than possible under the prior art. The average learning curve to operate the tool is fifteen (15) to twenty (20) minutes. The tool is also easy to clean and service. The tool comprises two components: an improved blade assembly and an improved driving mechanism. These improvements may be employed in the tool separately or together.

The current tool uses fewer parts to achieve the same function as a cam-driven shingle-removing tool by providing a crank-driven driving assembly. The crank converts the circular/rotary motion of the motor shaft to eccentric motion, which is in turn converted to rectilinear motion to drive the driving bars of the blade. This results in a lighter tool than available in the prior art. The crank-driven blade driving assembly also minimizes the wear and tear due to the reduction in parts. A blade driving assembly, as used herein, may be any assembly that effects the driving of a blade assembly. Also, cam-driven blade driving assemblies cause vibration in the tool structure that ultimately results in a shorter tool life. The improved driving assembly more securely interconnects the components of the tool thus resulting in less vibration and a longer life. Further reduction in vibration is achieved by incorporating bearing blocks to align the driving bars of the tool. Also, throughout the entire tool, ball bearings are incorporated anytime component parts will move against one another to further reduce friction and extend the life of the tool.

The tool includes an improved blade assembly, which includes a scalloped cutting edge and the ability to move the blade from side to side. These features/components efficiently "ratchet" roofing nails out of the roof sheathing substrate. The tool may be operated by using forward pressure on the handle. When operated at the recommended speed (about 3400–3600 RPM), the aforementioned improvements act to quickly lift nails out of a roofing substrate or, if the lifting action is not successful, to cut through the nail in the traditional manner. A typical roofing nail is generally removed with about 10–20 strikes by the blade.

The tool comprises a mounting board that supports components of the blade driving assembly and the blade assembly. The blade driving assembly comprises a blade (with top and bottom horizontal surfaces), a support member (with a vertical and horizontal portions), and driving shafts. The top horizontal surface of the blade is affixed to the bottom horizontal surface of the support member. A pair of parallel blade driving bars (shafts) are affixed to the support member's vertical surface. Thus, when the shafts are pushed forward, the shafts push the support member and the support member pushes the blade. The blade's side to side motion is effected by a rod and bearing assembly. The parallel blade driving bars extend rearward and are slidably mounted through a pair of front support bearing blocks. The blade driving bars are affixed to a shaft plate, which extends transversely of the mounting board. The shaft plate and the driven bars form a rectangular frame-like structure to which the support member is attached. The shafts may also pass through rear support bearing blocks. The bearing blocks are affixed to the mounting board through a plurality of bolts. The openings in the bearing blocks, through which the shafts slide, are further lined with a flexible material, such as neoprene, to reduce vibration caused by the action of the shafts sliding back and forth when the tool is in operation.

By virtue of this construction, the blade may be reciprocated between a forward position and a rearward position. The blade is transferred between its forward position and rearward position via a pistonlike motion achieved by the operation of the following elements: a motor, motor shaft, crank, connecting rod, shaft plate, and shafts. A motor transmits circular/rotary motion from a motor shaft to a crank with an offset hole so that the circular/rotary motion is converted into eccentric motion. The eccentric motion of the crank is transferred to the connecting rod in the form of rectilinear motion. The connecting rod is connected to the shaft plate, preferably via a wrist pin. The wrist pin more securely interconnects the shaft plate and the connecting rod. This helps stabilize the connecting rod and the shaft plate thus reducing vibration and wear/tear on the tool. The motion of the shaft plate is imparted to the shafts and then to the blade assembly.

The mounting board is provided with a removable cover and the tool is provided with a handle which may be adjusted with respect to the mounting board by adjustment knobs threadedly engaged in the rear support bearing blocks.

The following illustrates another embodiment of the invention.

Figure 2:
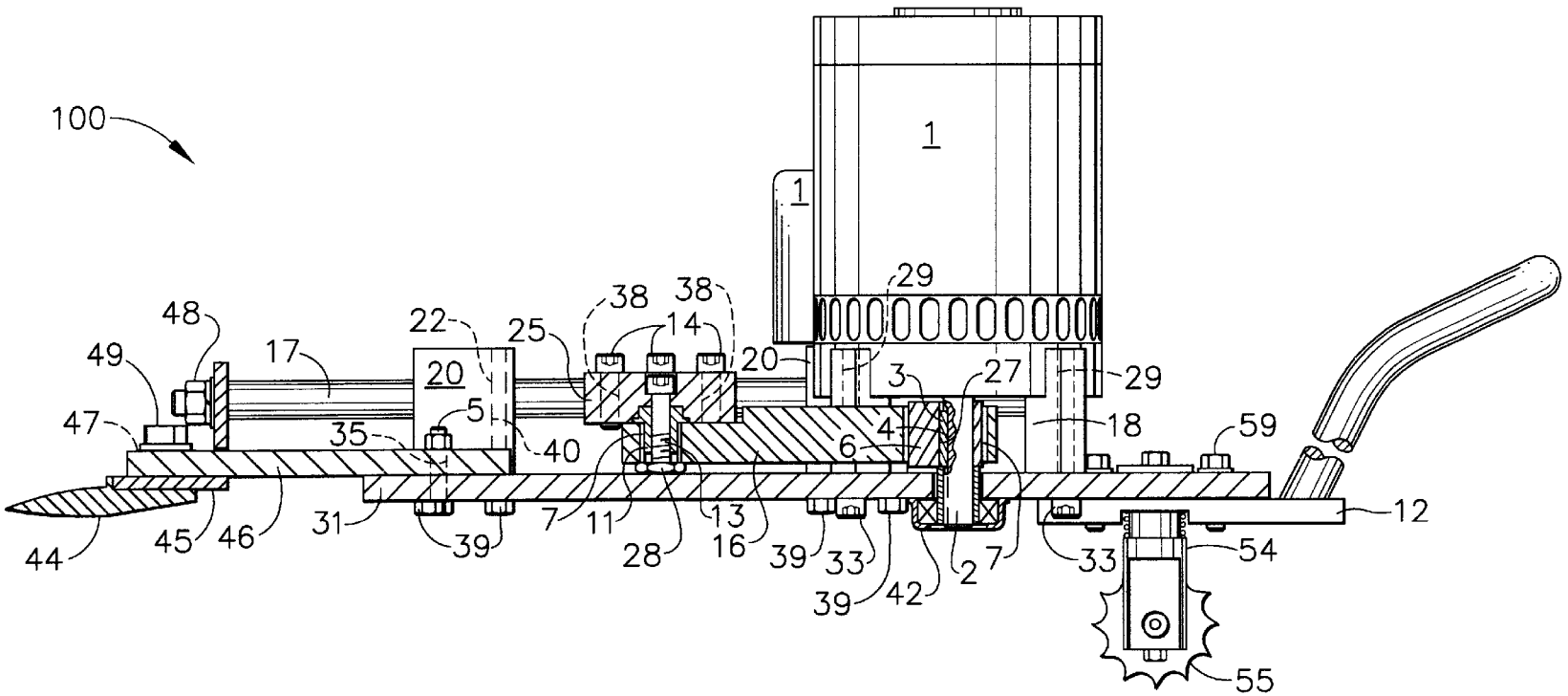
FIG. 2 is a side view of the tool of FIG. 1.
Figure 3:
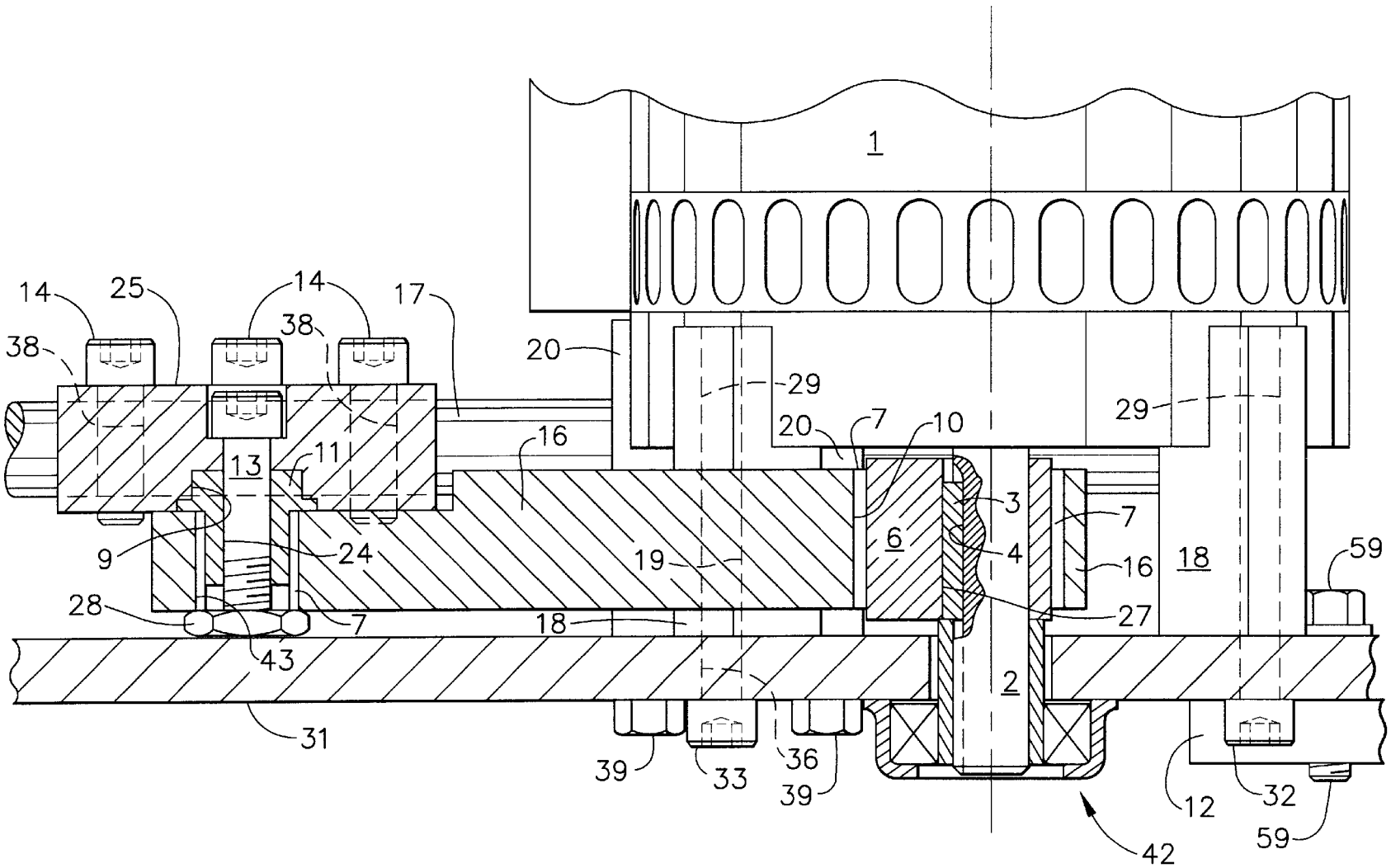
FIG. 3 is an enlarged, fragmentary side view of the tool of FIG. 1 showing the motor, connecting rod, and shaft plate assembly in cross-section.
Figure 4:
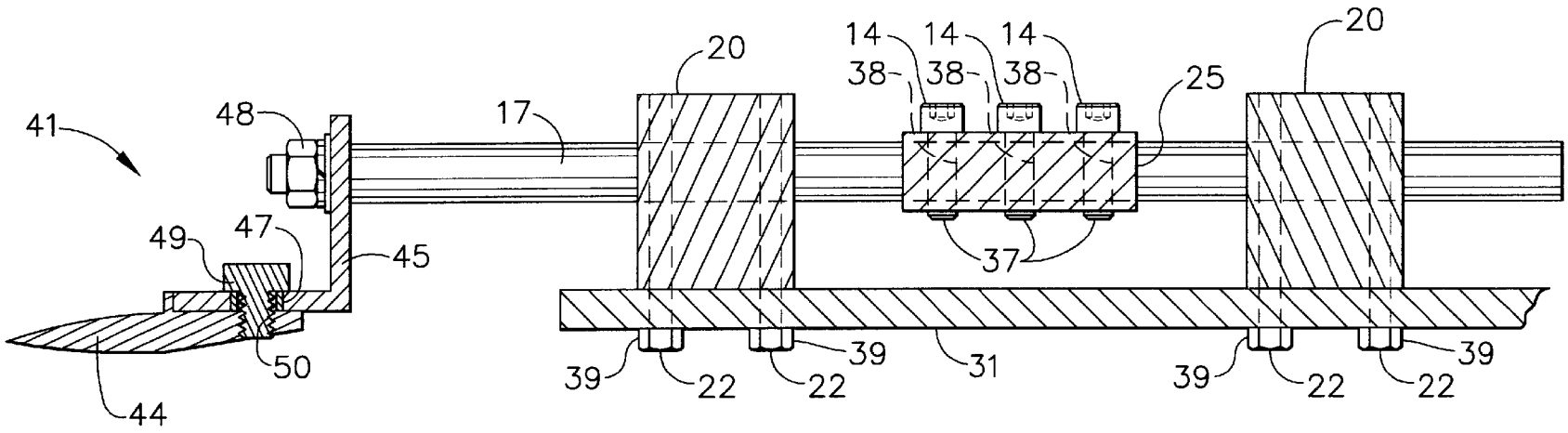
FIG. 4 is a fragmentary view, taken along line 4→4 of FIG. 1, showing the blade, shaft, and connecting rod assembly.

FIGS. 1–3 present an overall view of an embodiment of the present invention (100) from a top and side perspective. A motor (1) is bolted onto motor mount spacers (18) via a hole (29) in the motor (1) casing for the motor mount bolts (32). The motor mounts (18) are secured to the mounting board (31) by bolts (33) extending through holes in the mounting board (31) and secured by nuts. A motor shaft (2) extends from motor (1) through offset hole (8) of crank (6), through an opening in mounting board (31), and is supported by a support bearing (42) which is secured to mounting board (31) by an assortment of bolts and nuts disposed through holes in the mounting board. The motor shaft (2) is disposed perpendicular to the mounting board (31). The crank (6) is carried by connecting rod (16), which extends underneath the shaft plate (25). The connecting rod (16) and the shaft plate (25) are then connected in any conventional manner, such as by a wrist pin (11) which is secured in place by a bolt (13) and a nut (28). Shafts (17), also known as the driving bars, extend through bearing blocks (20) and the shaft plate (25). As described above, the rotational/circular motion of motor shaft (2) is converted to the reciprocating linear motion of shaft plate (25).

Referring to FIG. 3, the crank (6) is keyed to motor shaft (2) through a key (3). The crank (6) is then inserted through a needle bearing (7) in the connecting rod (16). The needle bearing (7) permits the crank to rotate with less friction. More specifically, the connecting rod (16) rides against needle bearings (7) placed in the hole (10—See FIG. 3) in the crank (6) through which the connecting rod (16) fits. When the connecting rod (16) rotates in the hole of the crank (6), the needle bearings (7) alleviate the deteriorating effect that would otherwise be produced due to friction of the outside wall of the connecting rod (16) and the inside wall of the crank (6) rotating against one another.

The motor shaft (2) further extends into the support bearing (42). The support bearing (42) is mounted on mounting board (31), which supports components of the tool (100). The motor (1) may be secured to the mounting board (31). In a preferred embodiment, affixation is achieved by a plurality of mounting blocks (18), most preferably, at least, four mounting blocks (18). The mounting blocks (18) are positioned on the mounting board (31) in such locations as to not interfere with any other parts of the tool (100).

The motor operates as follows. In a preferred embodiment, the motor operates at about 3400 to 3600 revolutions per minute to effect the operation of removing shingles from the roof. Alternate speeds may be necessary to use the tool for other applications such as removing carpet attached to a floor with adhesive.

Figure 7A:
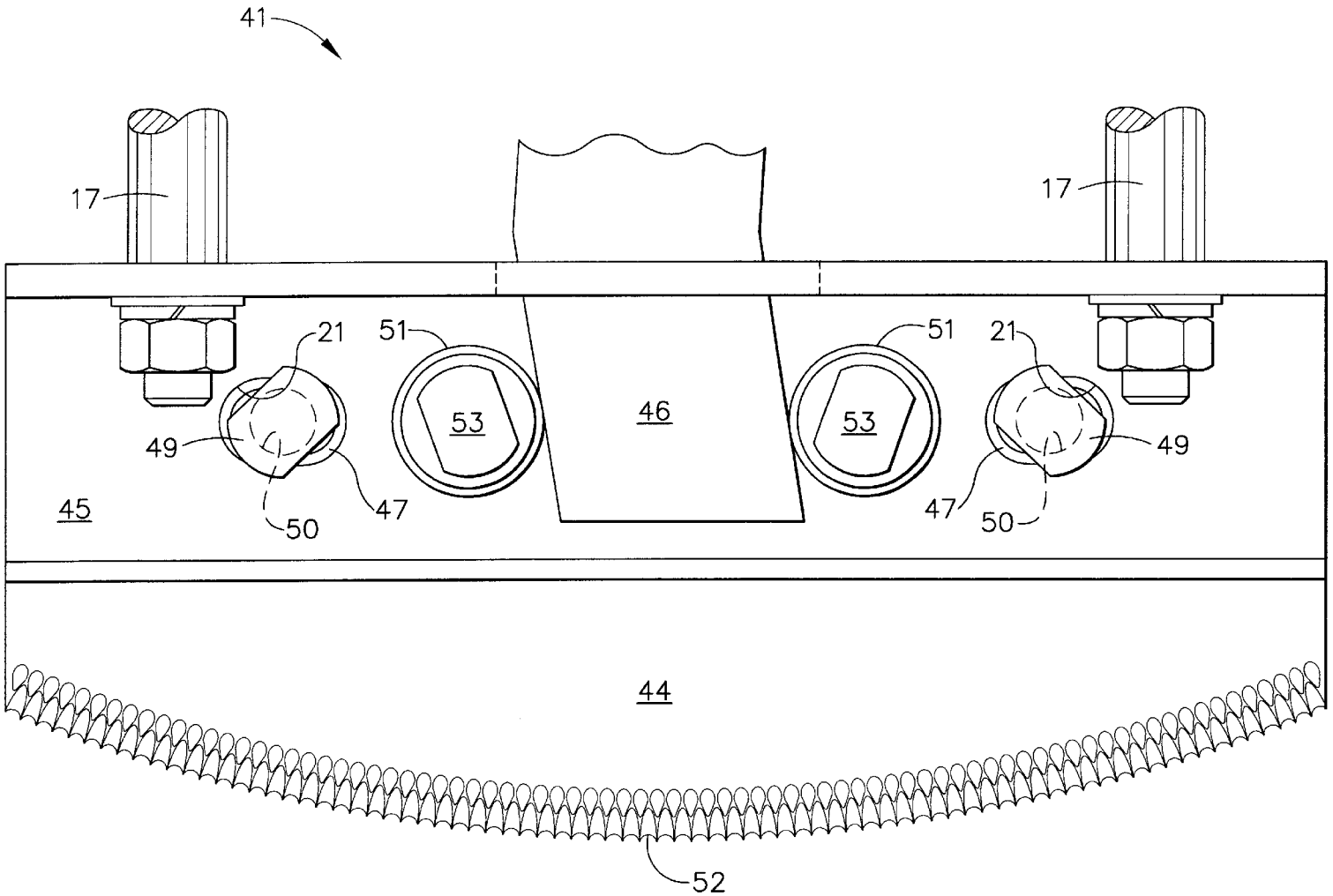
FIG. 7A is an enlarged top view of a blade assembly.

Power from the motor forces the motor shaft (2) to turn, the offset hole (8) in the crank (6) produces an eccentric motion in the crank (6) against or to the connecting rod (16). The eccentric motion of the crank (6) causes the end of the connecting rod (16a) to move forward and backward, as constrained by shaft plate (25), thus converting the eccentric motion to rectilinear motion. This, in turn, causes the shaft plate (25) (as well as the interconnected shafts (17)) to move forward/extend and then reverse/retract as the crank (6) makes a complete revolution. Referring to FIG. 7A, the shafts (17) ultimately force the blade (41) to extend forward and retract back.

The shaft plate (25) includes holes (15) through which the shafts (17) are inserted. Each shaft (17) contains at least one but preferably three or more holes through which bolts (14) extend to attach the shafts (17) to the shaft plate (25). The bolts are secured in place by any suitable method such as nuts (37). This construction allows the rectilinear motion of the end of the connecting rod (16*a*) to reciprocate to the shaft plate (25), and ultimately the shafts (17).

The mounting board (31) supports components of the tool (100). Front and rear bearing blocks (20) are bolted to the mounting board (31) via bolts (22). The front bearing blocks serve as aligmnent members for the shafts (17), which actuate the blade (44). In a preferred embodiment, both front and rear bearing blocks (20) should be present for each shaft (17). A plurality of fasteners, such as bolts (22), affix the bearing block (20) to the mounting board (31). (See FIG. 2). The bolts (22) do not extend through the shafts (17), otherwise the shafts (17) would be rendered immobile. Bearing blocks (20) carry a bearing (23) which slidably supports driving shaft (17), allowing reciprocating movement. Preferably, bearings (23) are backed by a resistant material, such as neoprene, to absorb vibration and to ease alignment of shafts (17) between the front and rear Blocks (20). In a preferred embodiment, bearings (23) impregnated with oil may be used to eliminate the use of grease fittings.

Thus, when parts of the tool (100) heats up due to the friction of the shaft (17) sliding in and out of the bearing blocks, the bearings (23) release oil to lubricate the inside of the bearing blocks (20) and reduce wear and tear on the tool (100). The bronze bearing (23) may be further encased in neoprene rubber to control vibration caused by the operation of the tool (100) and thus reduce wear and tear of the tool (100). The flexibility provided by the neoprene rubber casing permits the bronze bearing (23) to easily align the shafts (17) in their respective bearing blocks (20) from the front to the rear of the tool.

Figure 5:
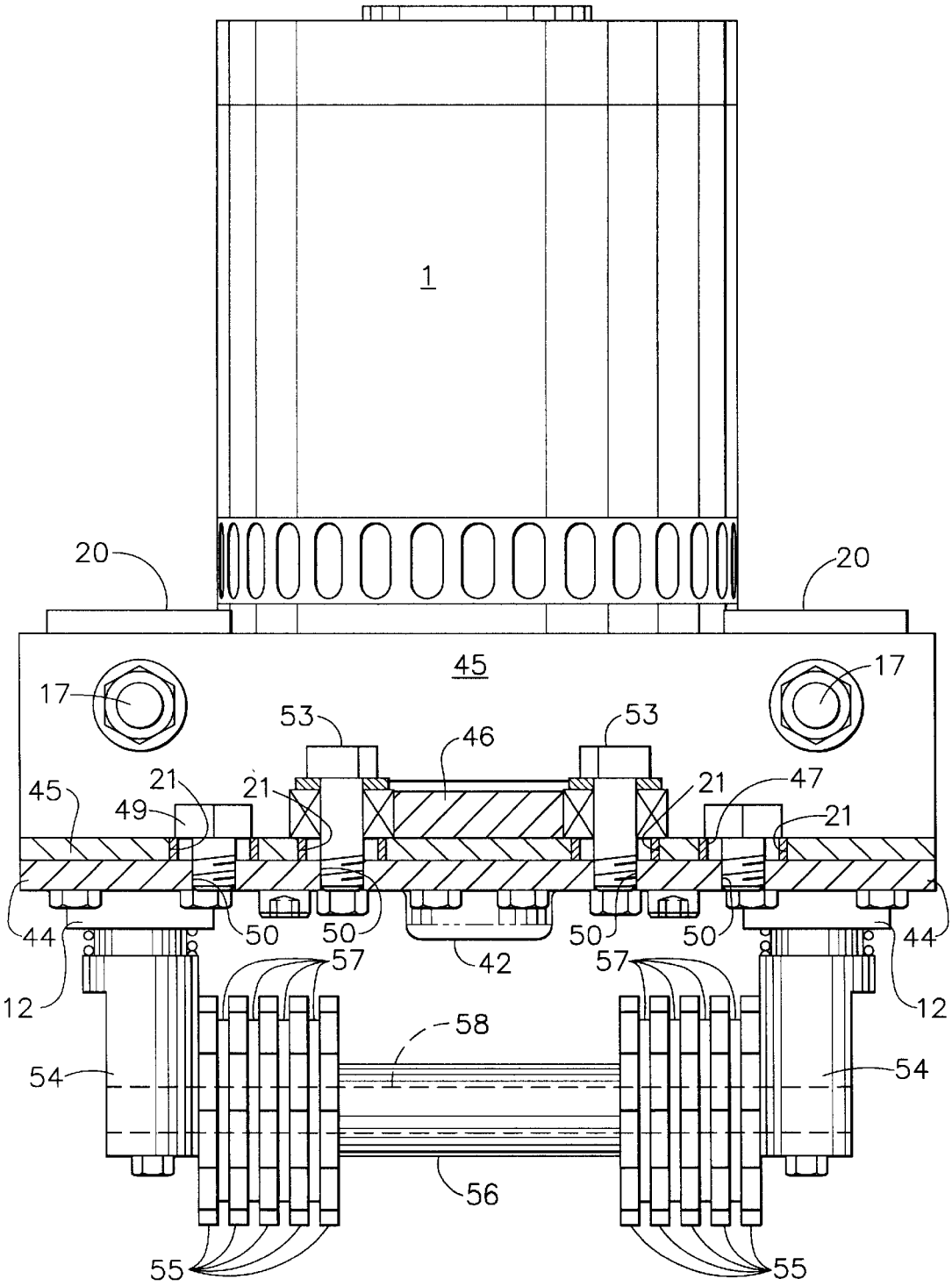
FIG. 5 is a front view of the tool of FIG. 1.

Referring to FIGS. 5 and 7, the blade (44) and the shafts (17) are connected to one another via an L-shaped support member (45). The support member (45) is preferably made of steel because the strength of the steel will prevent warping of the blade (44) from use of the tool (100). Other materials that provide the necessary strength are also acceptable. The shafts (17) are secured to the vertical portion of the L-shaped support member (45) via any suitable fastener, such as a nut (48). The blade (44) is affixed underneath the horizontal portion of the L-shaped support member (45) via any suitable fastener, such as bolts (49). The horizontal portion of the L-shaped support member (45) contains four aligned, slightly elongated shaped holes (21). The bearings (47) are disposed in holes (21) and are preferably bronze bearings impregnated with oil so that the bearings will provide lubrication to the tool to prevent deterioration due to heat generated from the friction of various parts moving against one another.

The bearings (47) permit the bolts (49), which affix the support member (45) to the blade, (44) to slide side-to-side when the blade (44) moves from side to side. The hole through the support member (45) is preferably non-threaded whereas the hole through the blade (44) is preferably threaded.

The lateral motion of the blade (44) is effected by the disposition of a side motion rod (46). This side motion rod (46) is affixed to the mounting board (31) via bolts (5) and slides through an opening in the vertical portion of the support member (45) to hang freely. The side motion rod (46) determines the blade's (44) side to side motion.

Figure 7B:
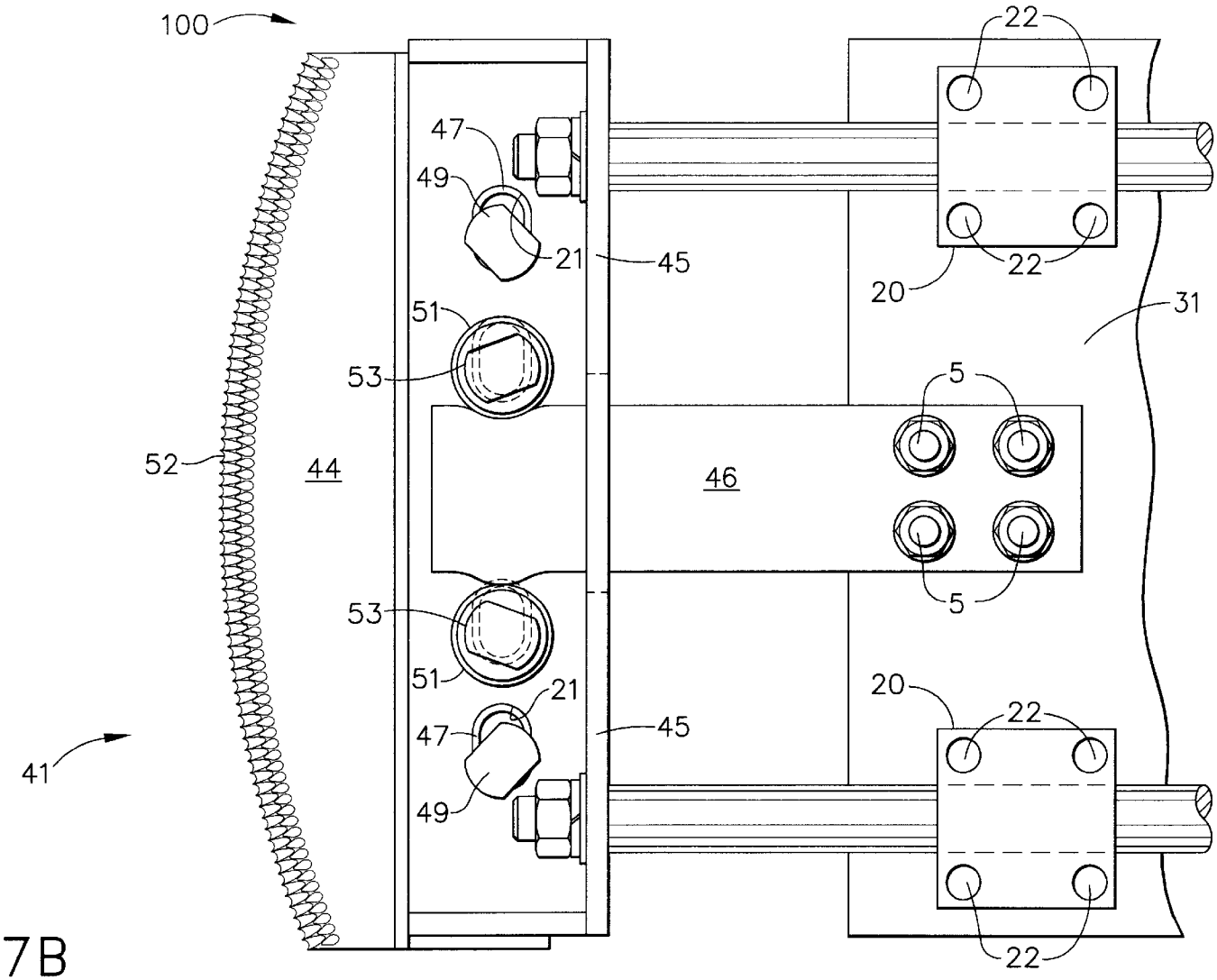
FIG. 7B is an enlarged top view of another blade assembly.

Referring to FIG. 7B, in another embodiment, the side motion rod (46) is designed with complementary radii: a protruding/convex radius on one side and an inside/concave radius on the other side. The convex radius of the side motion rod (46) is in alignment with the roller bearings (51), which are situated in the hole (21) of the support member (45), and the bolts (49). Thus when the blade (44) is thrust forward by the shafts (17), the bearings (51) follow the contour of the side motion rod (46) and reciprocates the blade (44) from side to side. The elongated/oval bearings (47) permit bolts (49, 53), which are holding the support member (45) and blade (44) together, to slide sideways rather than lock up and prevent the tool (100) from functioning. When the blade (44) is retracted, the roller bearings (51) are pushed in the opposite direction to return the blade (44) to its starting position. The side motion rod (46) is fixed in place and is substantially stationary. The blade preferably extends and retracts about one-quarter inch both forward and backward and from side-to-side.

Referring to FIG. 7A, the side motion rod (46) consists of a portion slanted approximately 5 to 25 degrees. The bolts (49, 53) and roller bearings (47, 51) are aligned with each other and disposed in holes (21) in the support member (45). The bearings follow the angle of the side motion rod (46) to produce the side-to-side movement. Thus when the blade (44) is thrust forward, approximately one-quarter inch, by the shafts (17), the support member portion of the side motion rod (46) hits the bolt (53) on the blade (44) and reciprocates the blade (44) from side to side. The bearings (47, 51) permit the bolts (49, 53), which are holding the support member (45) and blade (44) together, to slide sideways rather than lock up and prevent the tool (100) from functioning. When the blade (44) is retracted, the bolts (53) are pushed in the opposite direction to return the blade (44) to its starting position. The side motion rod (46) is fixed in place and is always stationary.

The blade (44) itself effects an improvement over blades used in prior art shingle removing tools. Rather than a straight edge, the blade (44) has a scalloped radius on its cutting edge (52) to effect both the lifting and cutting function of the shingles and nails. In a preferred embodiment, the scalloped edge (52) of the blade (44) has about 3/16 inch wide groove that is concave and about ½ inch long and about ⅛ inch deep. This groove is cut into the top leading edge of the blade (44). This creates a radius on the front edge of the scallops (52). The radius on the front edge of the scallops (52) partially encircles/captures the roofing nails and stops the blade (44) from sliding sideways on the nails. The partial encirclement of the nails causes more metal to metal contact between the nails and blade (44) and enables faster removal of the shingles and the nails. The support member of the front of the blade is about 5 to 15 degrees on both the top and the bottom so that when the when the tool is pushed forward, it is level with the roof. The blade is preferably constructed from carbon steel such as A-2 Steel. The cutting edge of the blade should also, preferably, be flame hardened for improved durability.

Figure 6:
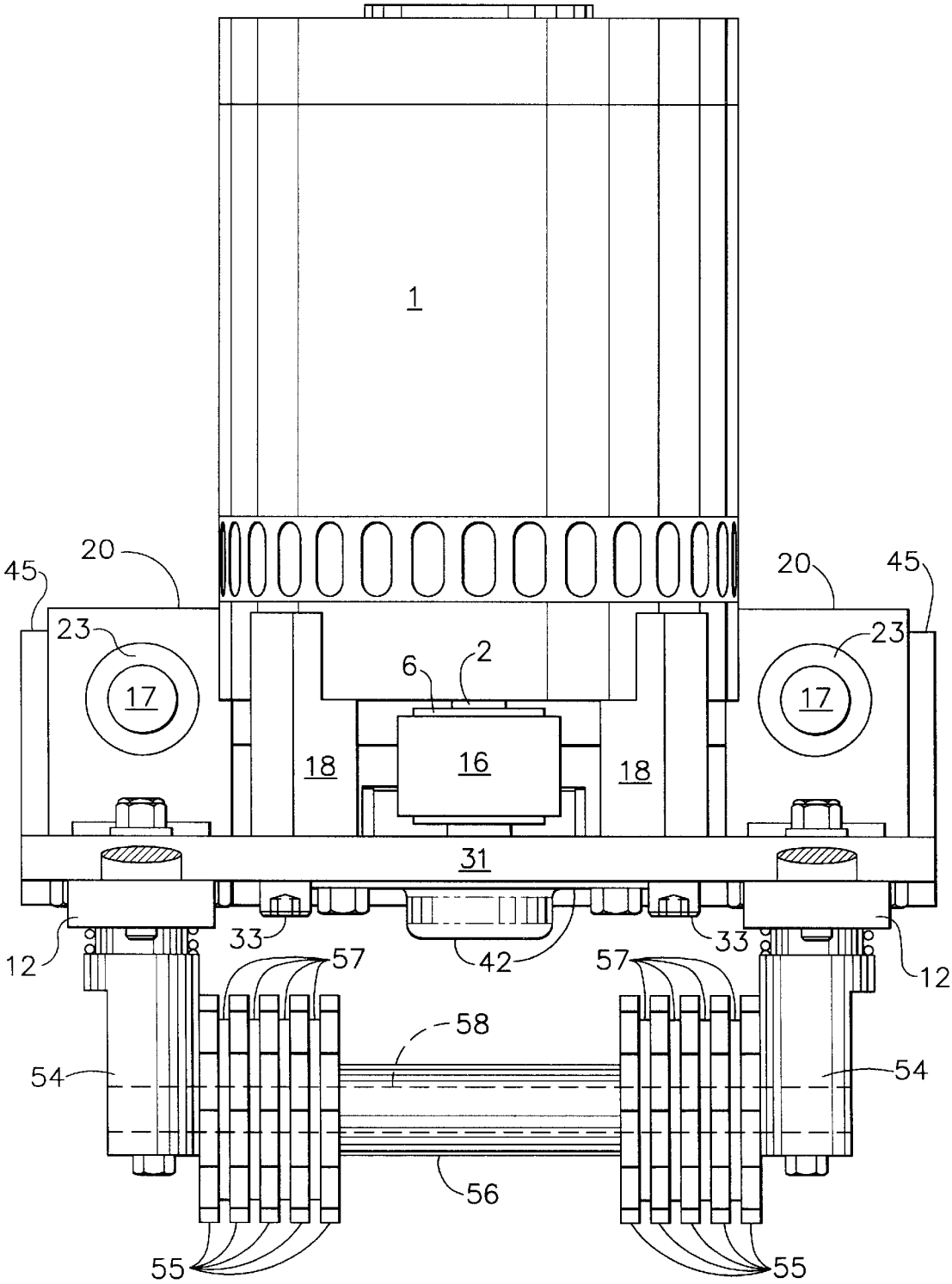
FIG. 6 is rear view of the tool of FIG. 1.

Referring to FIGS. 5 and 6, front and back perspectives of the tool (100) are shown. In particular, these figures illustrate the use of an optional wheel (55) to assist the operator of the tool (100) in digging into the substrate to provide greater leverage dueling the operation of the tool (100). At least one and preferably more wheels (55) or multiple sets of wheels may be mounted on the bottom portion of the handle (12). Shock absorbers (54), such as springs, may be provided between the wheels (55) and mounting board (31). The shock absorbers (54) allow the wheels to relevel at the level of the blade against the substrate of the roof by allowing the wheels (55) to move up and down. The wheels (55) preferably have sharp protrusions for digging into the substrate/sheathing of the roof. The wheels (55) are disposed on an axle (58). Sets of wheels may be spaced apart via a wheel spacer (56). A needle clutch bearing (57) may be disposed in between individual wheels to ensure that the wheels (55) will not roll backward while the tool (100) is in operation.

The operator of the tool may put forward pressure on or to the handle (12), which is attached to the tool (100), to ratchet (steadily progress up and down) nails out of roofing sheathing.

Modifications may be made in the tool without departing from the spirit of the invention. The exterior of the tool is substantially similar to the tool depicted in prior patent application Ser. No. 09/193,949, now U.S. Pat. No. 6,105,470.

What is claimed:

1. A tool capable of removing stratum, comprising:

a. a laterally and longitudinally reciprocating blade wherein said blade comprises an arcuate, scalloped edge;

b. a support;

c. a rod, having a first end and a second end, and having a concave portion and a convex portion; and d. a mounting board;

wherein:

said blade is carried by said support; and said rod is carried by said mounting board; and said concave and convex portions of said rod interact with said blade to produce said lateral reciprocation in said blade as said support reciprocates longitudinally.

2. A tool as claimed in claim 1, further comprising at least two longitudinally reciprocating members wherein said at least two longitudinally reciprocating members longitudinally reciprocate said support.

3. A tool, as claimed in claim 2, further comprising at least two bearing blocks whereby said bearing blocks slidably carry a respective one of said at least two longitudinally reciprocating members and whereby said bearing blocks are carried by said mounting board.

4. A tool, as claimed in claim 3, further comprising a transverse member, relative to said at least two longitudinally reciprocating members, whereby said at least two longitudinally reciprocating members are carried by said transverse member.

5. A tool, as claimed in claim 1, further comprising:

a. at least two protrusions, comprising a first protrusion and a second protrusion, which are fixedly carried by said blade;

wherein said convex portion of said rod interacts with said first protrusion and said concave portion of said rod interacts with said second protrusion to reciprocate said blade.

6. A tool, as claimed in claim 5, wherein:

said protrusions extends through said support and said protrusions are laterally reciprocal relative to said support; and said convex and concave rod portions interact with said protrusions where said protrusions extend through said support.

* * * * *